US005881586A

United States Patent [19]

Shen

[11] Patent Number: 5,881,586

[45] Date of Patent: Mar. 16, 1999

[54] LOCKSET CARTRIDGE WITH A SMOOTH GUIDE

[76] Inventor: Mu-lin Shen, No. 32, Lane 76, Sec. 5, Fu-an Rd., Tainan, Taiwan

[21] Appl. No.: 890,455

[22] Filed: Jul. 9, 1997

Related U.S. Application Data

[63] Continuation of Ser. No. 655,859, May 31, 1996, abandoned.

[51] Int. Cl.[6] ..... E05B 59/00

[52] U.S. Cl. ..... 70/107; 70/462; 292/34

[58] Field of Search ..... 70/107–111; 292/34, 292/92, 336.3

[56] References Cited

U.S. PATENT DOCUMENTS

| | | | |
|---|---|---|---|
| 3,910,613 | 10/1975 | Nolin | 292/34 |
| 3,990,277 | 11/1976 | Mullich | 70/107 |
| 3,999,789 | 12/1976 | Maurits et al. | 292/34 |
| 4,011,741 | 3/1977 | Nolin | 70/107 |
| 4,129,019 | 12/1978 | Urdal | 70/107 |
| 4,156,541 | 5/1979 | Babb, Jr. et al. | 292/21 |
| 4,183,563 | 1/1980 | Stevens | 292/34 |
| 4,276,760 | 7/1981 | Nolin | 70/107 |
| 4,418,552 | 12/1983 | Nolin | 70/107 |
| 4,809,526 | 3/1989 | Shen | 70/107 |
| 4,838,053 | 6/1989 | Shen | 70/92 |
| 4,934,800 | 6/1990 | Choi | 292/172 |
| 4,979,767 | 12/1990 | Lin | 292/336.3 |
| 4,982,986 | 1/1991 | Gressett, Jr. et al. | 292/336.3 |
| 5,325,687 | 7/1994 | Lin | 70/107 |
| 5,492,380 | 2/1996 | Smallegan et al. | 292/336.3 |
| 5,496,082 | 3/1996 | Zuckerman | 292/336.3 |
| 5,513,505 | 5/1996 | Dancs | 70/107 |
| 5,544,507 | 8/1996 | Lin | 70/107 |

*Primary Examiner*—Suzanne Dino Barrett
*Assistant Examiner*—Teri Pham
*Attorney, Agent, or Firm*—Parkhurst & Wendel, L.L.P.

[57] ABSTRACT

A cartridge for a lockset comprising a planar bottom plate and a number of housings, with a respective space of predetermined height being defined between each of the housings and the bottom plate, respectively. Within the respective spaces, a swivel, a slide and a driver of the cartridge are disposed to cooperate. At least one guider is provided on the bottom plate. The slide has a number of lengthwise slots each corresponding to one guider so as to be guided by the at least one guider to reliably slide within the corresponding space. The slide has a lower side portion and the driver has a matching upper side portion in order for the driver to smoothly actuate the slide.

9 Claims, 9 Drawing Sheets

LOCKSET CARTRIDGE WITH A SMOOTH GUIDE

This is a continuation of application Ser. No. 08/655,859 filed May 31, 1996, now abandoned.

BACKGROUND OF THE INVENTION

1. Field of the Invention

The present invention relates to a cartridge for two individual, standard lock devices, collectively referred to as a lockset, utilized on a door panel in connection with the door frame. The cartridge inter-engages with the spindle of the individual locks to join the lock devices together. The device is arranged to be easily installed with unchanged standard lock mechanisms. The cartridge is so constructed as to operate smoothly and reliably.

2. Description of Related Art

U.S. Pat. No. 4,129,019, issued to Urdal on Dec. 12, 1978, discloses a cartridge for a lockset which comprises a first and a second cartridge plates having edge flanges thereon, a rocker lever, a slide, a rotary lever and a lever arm included with the rotary lever. The cartridge plates are directly to each other and are spaced apart by the edge flanges to provide a predetermined space therebetween. It is important that there is a sufficiently smooth movement of the slide with respect to the cartridge plates. This is achieved, according to the Urdal patent, by providing both rounded shoes or bevels on the slide and embossed bearing discs on each cartridge plate. However, the rounded shoes or bevels of the slide in cooperation with the edge flanges of the cartridge plates may produce some slight distortion about an axis of a general plane of the cartridge plates in operation. The situation of distortion is present particularly in view of the fact that the rocker lever uses one of its horizontally extending lever arms to abut and move a corresponding primary lug of the slide at a bottom rightmost or leftmost portion thereof.

Another problem associated with this prior design is that the spaced-apart distance between the first and second cartridge plates as maintained by the edge flanges is not constant. For example, a tightening force for fastening the cartridge plates together may readily and easily change the spaced-apart distance which in turn adversely affects the operating situation of the slide situated and to be moved within the spaced-apart distance.

SUMMARY OF THE INVENTION

A primary object of the present invention is to provide an improved lockset cartridge of which the operation to unlock the lockset can be performed smoothly and reliably.

To achieve this object, according to the present invention, the lockset cartridge comprises a bottom plate and an upper and a lower housings, and means for positively maintaining a respective space between the upper housing and the bottom plate and between the lower housing and the bottom plate to be of such a predetermined height which is substantially constant. In this way, a slide can be actuated to be slidable along a lengthwise direction of the bottom plate in the spaces defined between the upper and lower housings and the bottom plate in a reliably guided manner.

In particular, according to one feature of the present invention, the means for positively maintaining comprises a pair of first spacer posts each having one end seated on the bottom plate and another end seated on the upper housing, and a pair of second spacer posts each having one end seated on the bottom plate and another end seated on the lower housing. Therefore, fastening means such as screws can suitably pass through the first and second spacer posts where even a larger force can be applied to the screws without affecting or changing the predetermined height of the spaces defined between the upper and lower housings and the bottom plate.

According to another feature of the present invention, the bottom plate comprises a spacer step raised from a bottom face thereof and the upper and lower housings are shaped as a substantially flat plate. The spacer step together with the upper and lower housings form respective spaces between the bottom plate and the upper and lower housings. Preferably, the spacer step comprises a pair of substantially straight guiding walls. The spaces enclosed by the upper and lower housings and the straight guiding walls of the spacer step on the bottom plate thus define an reliably controlled space for elements operating therein.

Other objects, advantages and novel features of the invention will become more apparent from the following detailed description when taken in conjunction with the accompanying drawings.

DETAILED DESCRIPTION OF PREFERRED EMBODIMENT

Figure 1:
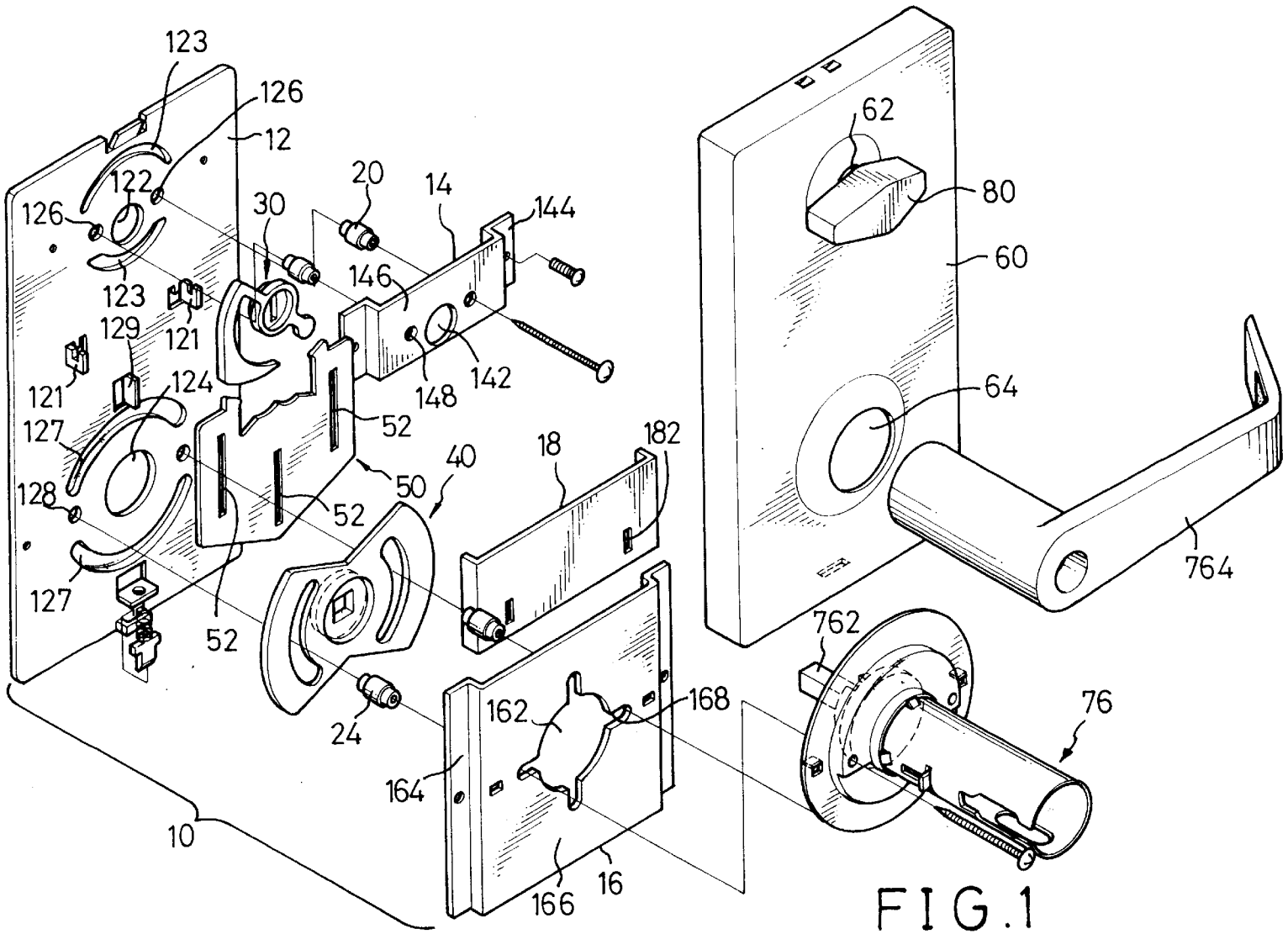
FIG. 1 is an exploded perspective view of a cartridge mechanism constructed in accordance with one embodiment of the present invention and various parts, like a lever handle and an inside assembly, associated with the cartridge mechanism.
Figure 2:
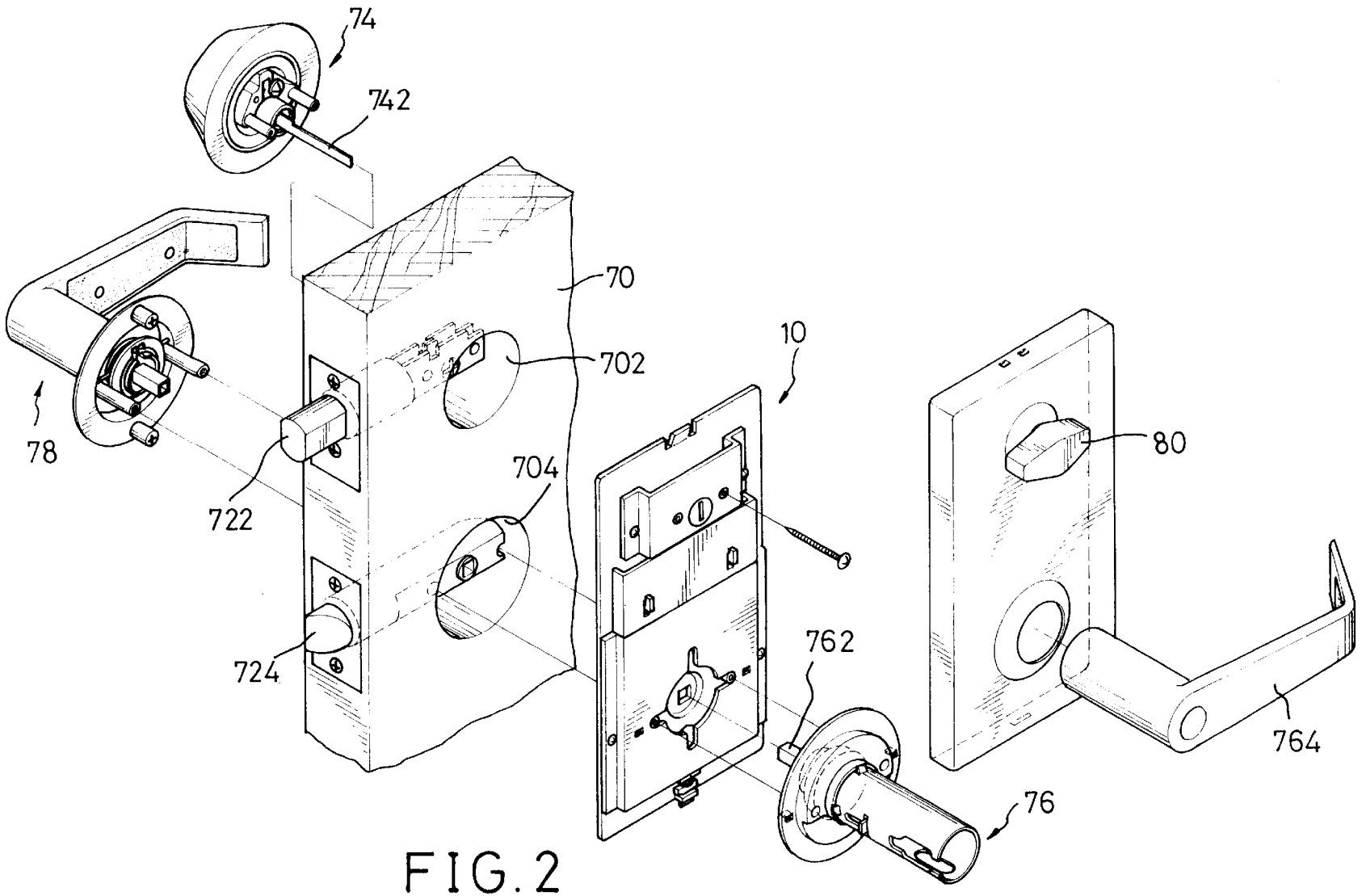
FIG. 2 is a view similar to FIG. 1 but showing an assembled cartridge mechanism, other associated parts such as a partly broken door and a deadbolt assembly also being shown.
Figure 3:
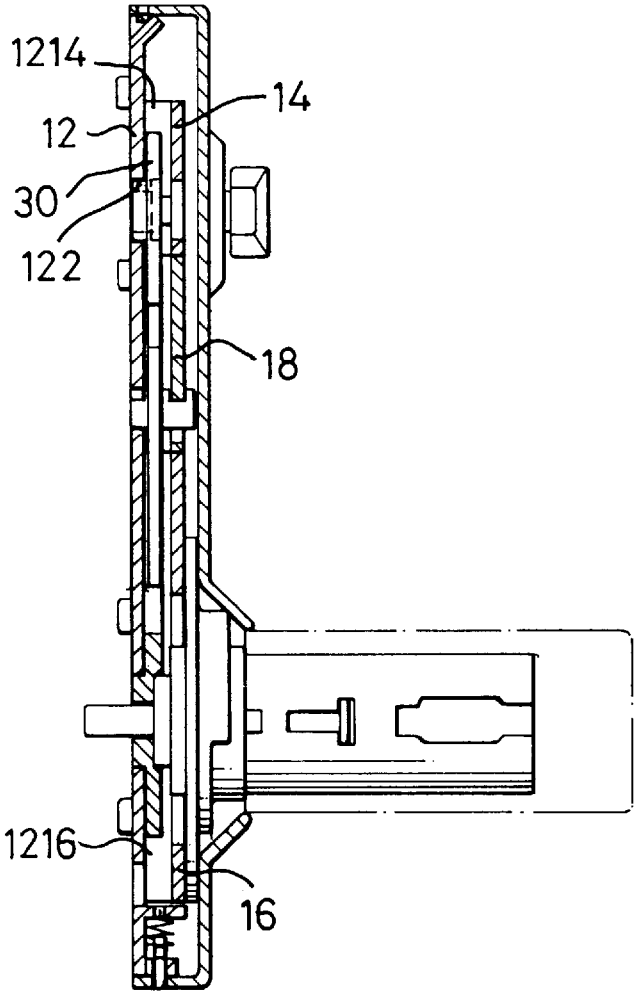
FIG. 3 is a lengthwise cross-sectional view of the assembled cartridge mechanism.

Referring to the drawings and initially to FIGS. 1 and 2, the usual environment for the lockset cartridge is in connection with a door panel 70 to be hingedly mounted to an ordinary door frame, a deadbolt mechanism including a deadbolt 722, a latchbolt mechanism including a latchbolt 724, a deadbolt assembly 74 for manipulating the deadbolt mechanism, an inside assembly 76 including a spindle 762 and operable by a lever handle 764, an outside assembly 78 in connection with the inside assembly 76, and a thumb turn 80 for manipulating a spindle 742 of the deadbolt assembly 74. These components, constituting an ordinary lockset, their inter-relationship and operation, are generally known and not forming part of the present invention so that a detailed description thereof is not provided herein.

As mentioned previously, the present invention lies in the provision of a cartridge or cartridge mechanism 10 on the inside of the door locks. The cartridge 10 is further disposed between the deadbolt assembly 74 and the inside assembly 76 in view of the fact that both the spindle 742 of the deadbolt assembly 74 and the spindle 762 of the inside assembly 76 pass through the cartridge 10.

Referring again to FIG. 1 and further to FIGS. 3 through 6, the cartridge 10 comprises a bottom plate 12 of a substantially rectangular shape, an upper and a lower housings 14 and 16 fixed to the bottom plate 12 and a middle housing 18 situated between the upper and lower housings 14 and 16. The bottom plate 12 has a first opening 122 and a second opening 124. The upper housing 14 has an opening 142 corresponding to and aligned with the first opening 122 of the plate 12 and the lower housing 16 has an opening 162 corresponding to and aligned with the second opening 124 of the plate 12. The openings 122, 142 and 124, 162 are where the spindle 742 and the spindle 762 pass, respectively, to perform their ordinary functions, i.e., to control the deadbolt 722 and the latchbolt 724.

The upper housing 14 has a pair of angled flanges 144 formed at two lateral sides thereof. The lower housing 16 has a pair of angled flanges 164 formed at two lateral sides thereof. The upper and lower housings 14 and 16 can be fastened, for example by screws passing through threaded holes provided on the flanges 144 and 164 and on the bottom plate 12. Between the angled flanges 144, a raised portion 146 is formed as spaced a predetermined height from the bottom plate 12 to define a space 1214 between the upper housing 14 and the bottom plate 12. Similarly, between the angled flanges 164, a raised portion 166 is formed as spaced a predetermined height from the bottom plate 12 to define a space 1216 between the upper housing 16 and the bottom plate 12.

Adjacent to the first opening 122, a pair of holes 126 are provided and, similarly, a pair of holes 128 are provided adjacent to the second opening 124. Opposite the holes 126 and 128, corresponding holes 148 and recesses 168 are provided adjacent to the openings 142 and 162, respectively. Holes 126 and 148 cooperate to mount first spacer posts 20 and holes 128 and recesses 168 cooperate to mount second spacer posts 24. Each of the first and second spacer posts 20 and 24 are hollow and have both narrowed ends accommodated to the size of the holes 126, 148, 128 or recesses 168.

Spacers 20 and 24 serve a purpose that set screws may be suitably provided, passing through the hollow center of the first and second spacer posts 20 and 24, for fastening the inside assembly 76 and the outside assembly 78 to each other, together with the cartridge 10 interposed therebetween, and onto the door panel 70. More importantly, according to the invention, the first and second spacer posts 20 and 24 thus situated between the bottom plate 12 and the upper housing 14 and between the bottom plate 12 and the lower housing 16, respectively, can positively maintain the predetermined height between the bottom plate 12 and the upper and lower housing 14 and 16 substantially constant.

Figure 4:
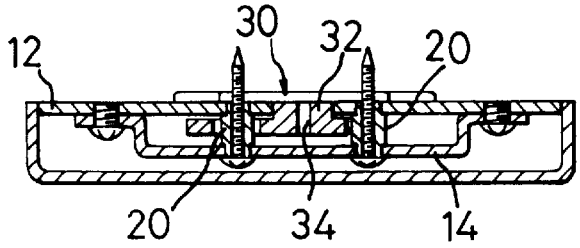
FIG. 4 shows a cross-section taken along an upper housing of the cartridge mechanism.
Figure 5:
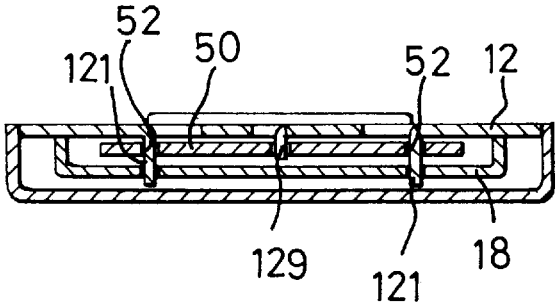
FIG. 5 shows a cross-section taken along a middle housing of the cartridge mechanism.
Figure 6:
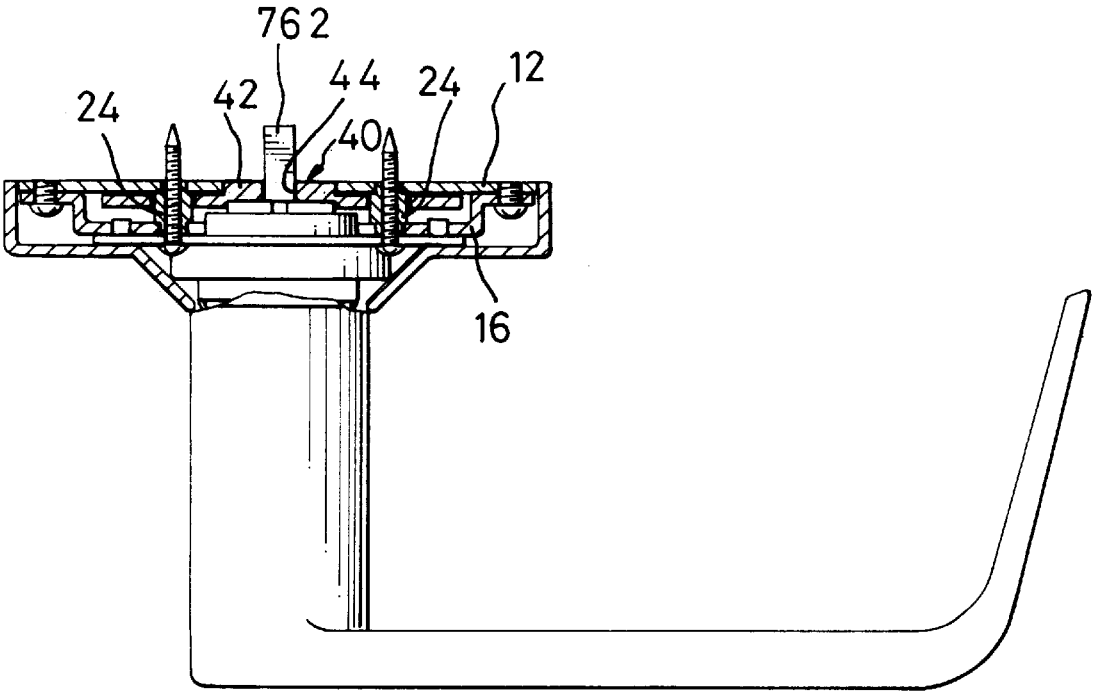
FIG. 6 shows a cross-section taken along a lower housing of the cartridge mechanism.

As can be clearly seen in FIG. 4, the predetermined height between the bottom plate 12 and the upper housing 14 provides a space within which a swivel 30 can move reliably without the possibility of interfering either the bottom plate 12 or the upper housing 14. Operation of the swivel 30 and its relationship to other components are to be further described below. Also, as can be clearly seen in FIG. 6, the predetermined height between the bottom plate 12 and the lower housing 16 provides a space within which a driver 40 can move reliably without the possibility of interfering either the bottom plate 12 or the lower housing 16. Operation of the driver 40 and its relationship to other components are to be further described below.

The middle housing 18 to be situated between the upper and lower housings 14 and 16 has a pair of slots 182. Correspondingly, the portion of the bottom plate 12 which faces the middle housing 18 has a pair of guiders 121 which, for example, may be punched out of the bottom plate 12 and in the form of guiding hooks. Each of the guiders 121 is notched at an upper side thereof so that the middle housing 18 may sit upon it. In this way, once the middle housing 18 sits upon the notched guiders 121 with the upper and lower housings 14 and 16 positioned adjacent to upper and lower sides thereof, a firm and secure positioning of the middle housing 18 with respect to the bottom plate 12 can thus be obtained.

The cartridge 10 also comprises a slide 50. The slide 50, the swivel 30 and the driver 40 are to be operatingly received in the spaces defined between the bottom plate 12 and the housings 18, 14, 16. For this purpose, the swivel 30 has a journal 32 (cf. FIG. 4) for engaging into the opening 122 of the bottom plate 12 so that the swivel 30 is rotatably held within the space defined between the bottom plate 12 and the upper housing 14. An elongate spindle slot 34 is formed on the swivel 30 for passage of the spindle 742 so that a turning movement of the swivel 30 on the plane of the bottom plate 12 will also turn the spindle 742, and vice versa. The slide 50 has, for example, three lengthwise slots each aligned with one of the guiders 121 and another guider 129 formed like a projection below the guiders 121 on the bottom plate 12. It is noted that, unlike prior design, the slide 50 of the invention has a width, measured along a direction perpendicular to the lengthwise direction of the bottom plate 12, which is far less than that of the bottom plate. In this construction, the slide 50 can slide under the guide of the guiders 121, 129 along a lengthwise direction of the bottom plate 12 in the space between the bottom plate 12 and the middle housing 18 to turn the swivel 30 without interfering with other adjacent components of the cartridge 10. Like the swivel 30, the driver 40 also has a journal 42 for engaging into the opening 124 of the bottom plate 12 so that the driver 40 is rotatable in the opening 124 within the space defined between the bottom plate 12 and the lower housing 16. A spindle slot 44 is formed on the driver 40 for passage of the spindle 762 so that a turning movement of the spindle 762 will turn the driver 40 on the plane of the bottom plate 12.

Figure 8:
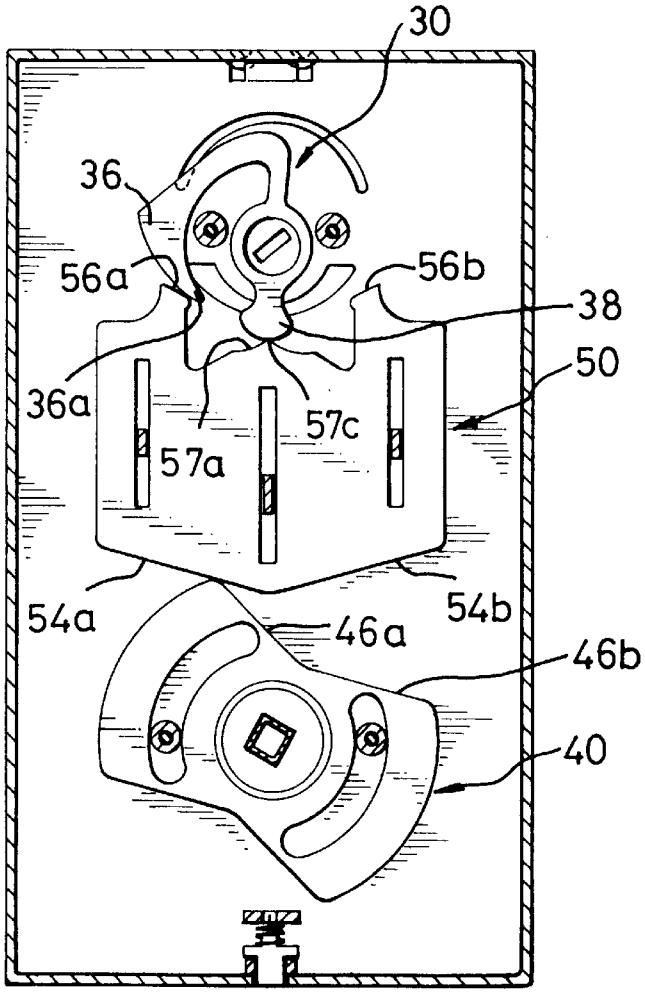
FIG. 8 is a view similar to FIG. 7 but showing a subsequent state of the operational components of the cartridge mechanism.
Figure 7:
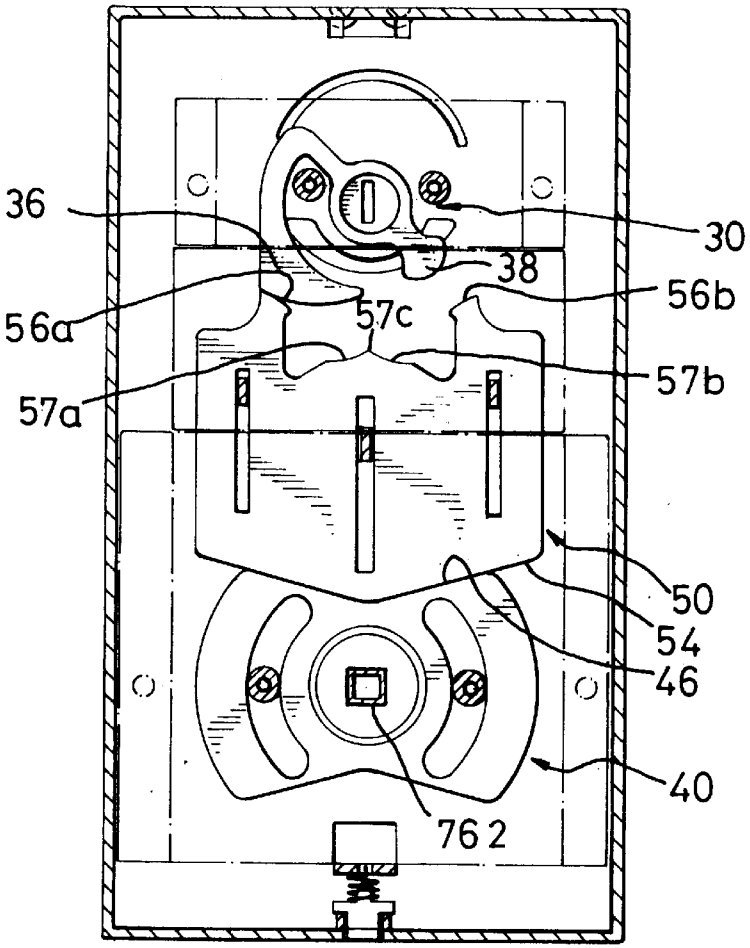
FIG. 7 is a schematic plan view showing an interconnection between the various operational components of the cartridge mechanism, the upper, middle and lower housings being shown in dashed lines to indicate their positional relationship.
Figure 9:
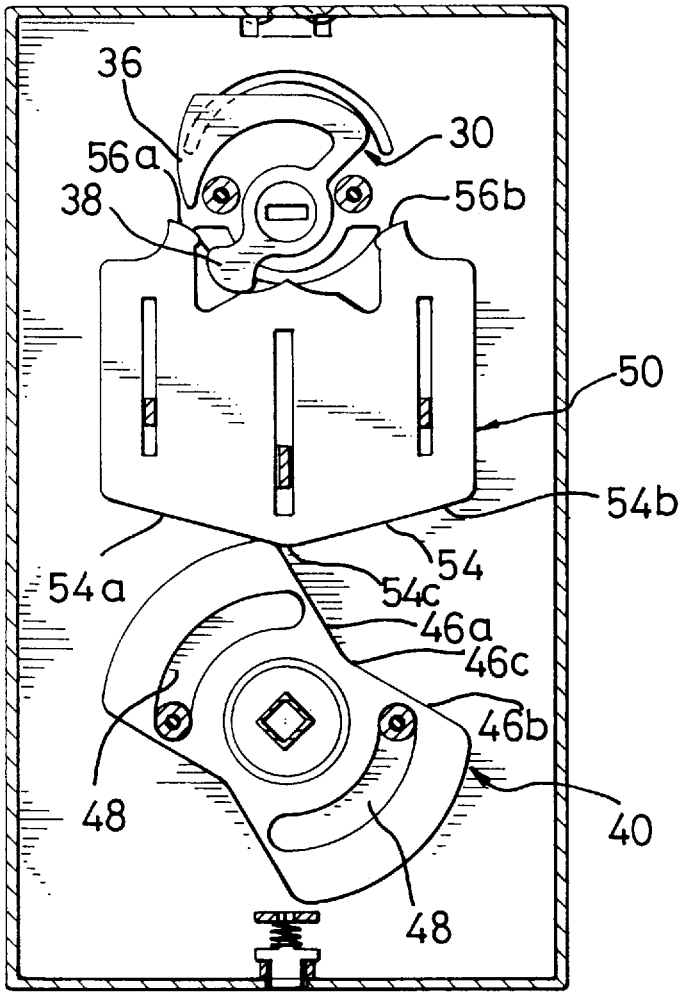
FIG. 9 is a view similar to FIG. 7 but showing a still subsequent state of the operational components of the cartridge mechanism.

Refer now to FIGS. 7, 8 and 9. The driver 40 has an upper side portion 46 constantly in contact with a lower side portion 54 of the slide 50 under the action of a gravity force acting on the slide 50 itself. As mentioned previously, the slide 50 is guided by the guiders 121, 129 so that it will always move up and down along the lengthwise direction of the bottom plate 12. As more clearly shown in FIG. 9, the lower side portion 54 of the slide 50 is composed of two substantially straight parts 54*a* and 54*b* joined approximately at an intermediate point to form a central convexity 54*c*. Correspondingly, the upper side portion 46 of the driver 40 is composed of two substantially straight parts 46*a* and 46*b* matching with the parts 54*a* and 54*b* of the lower side portion 54 and forming a central concavity 46*c*. On an upper side portion opposite to the lower side portion 54, the slide 50 has a pair of upper arms 56*a* and 56*b* and a pair of intermediate recesses 57*a* and 57*b*. A tip 57*c* is defined between the junction of the intermediate recesses 57*a* and 57*b*. Each of the arms 56*a*, 56*b* and the recesses 57*a*, 57*b* form a cam surface. The swivel 30 has a main or first cam arm 36 and an auxiliary or second cam arm 38. The first cam arm 36 is designed to contactingly engage with the cam surface of one of the pair of upper arms, in the embodiment shown the arm 56*a*, to then turn the swivel 30 in response to an upward sliding movement of the slide 50. The second cam arm 38 is designed to contactingly engage with the cam surface of the pair of intermediate recesses, in the embodiment shown the recess 57*a*, to further turn the swivel 30 in response to a continuing upward sliding movement of the slide 50.

Operation of the swivel 30, the slide 50 and the driver 40 will now be described with particular reference to FIGS. 7, 8 and 9 which successively show how the driver 40 drives the slide 50 to continuously turn the swivel 30 approximately 90°. In FIG. 7, the swivel 30 is shown to be in a locked position where the first cam arm 36 of the swivel 30 contacts or nearly contacts the upper arm 56*a* of the slide 50. To release the locked position of the swivel 30 by turning only the lever handle 764 (which has the effect of turning the driver 40) instead of directly turning the thumb turn 80 (which has the effect of turning the swivel 30 to release the locked position) as is the case, the driver 40 is turned, due to a turning movement of the 762, to drive the slide 50. FIG. 8 shows that the slide 50 is moved upward due to engagement of an outermost end of the straight part 46*a* with the corresponding straight part 54*a* thereof, while at the same time the swivel 30 is turned a certain degree by an upward movement of the driver 50. In the position of FIG. 8, the swivel 30 is shown to be turned approximately 45°, with a tip 36*a* of the first cam arm 36 contacting the arm 56*a* of the slide 50 and the second cam arm 38 contacting the tip 57*c* and starting to contact the recess 57*a* of the slide 50. Subsequent turning movement of the driver 40 results in a continuing upward movement of the slide 50, with the engagement between the second arm 38 and the recess 57*a* prevailing, until a further turning movement of the driver 40 is stopped due to a pair of curved grooves 48 provided on the driver 40 contact at a respective end thereof with the pair of second spacer posts 24. At this position, the swivel 30 is further turned approximately 45°. From the position of FIG. 7 to the position of FIG. 9, the swivel 30 turns a total of approximately 90°, thus releasing the locked position as desired.

It is noted that during the upwardly sliding movement of the slide 50, the driver 40 contacts the slide 50 at points which are gradually moving toward the central convexity 54*c*, resulting in a gradually smaller torque that is required to turn the driver 40.

It is noted that the bottom plate 12 may further comprise a pair of curved strips 123 surrounding the opening 122 and a pair of curved strips 127 surrounding the opening 124. The strips 123 and 127 protrude into openings 702 and 704 formed on the door panel 70, respectively, to assist in attaching the bottom plate 12 to the door panel 70.

The cartridge 10 is finally completed by mounting a cover 60 to the bottom plate 12 in a generally known way. As is necessary, two openings 62 and 64 are disposed on the cover 60, one for the combination of the thumb turn 80 and the spindle 742 and the other for the combination of the inside assembly 76 and the lever handle 764.

Figure 10:
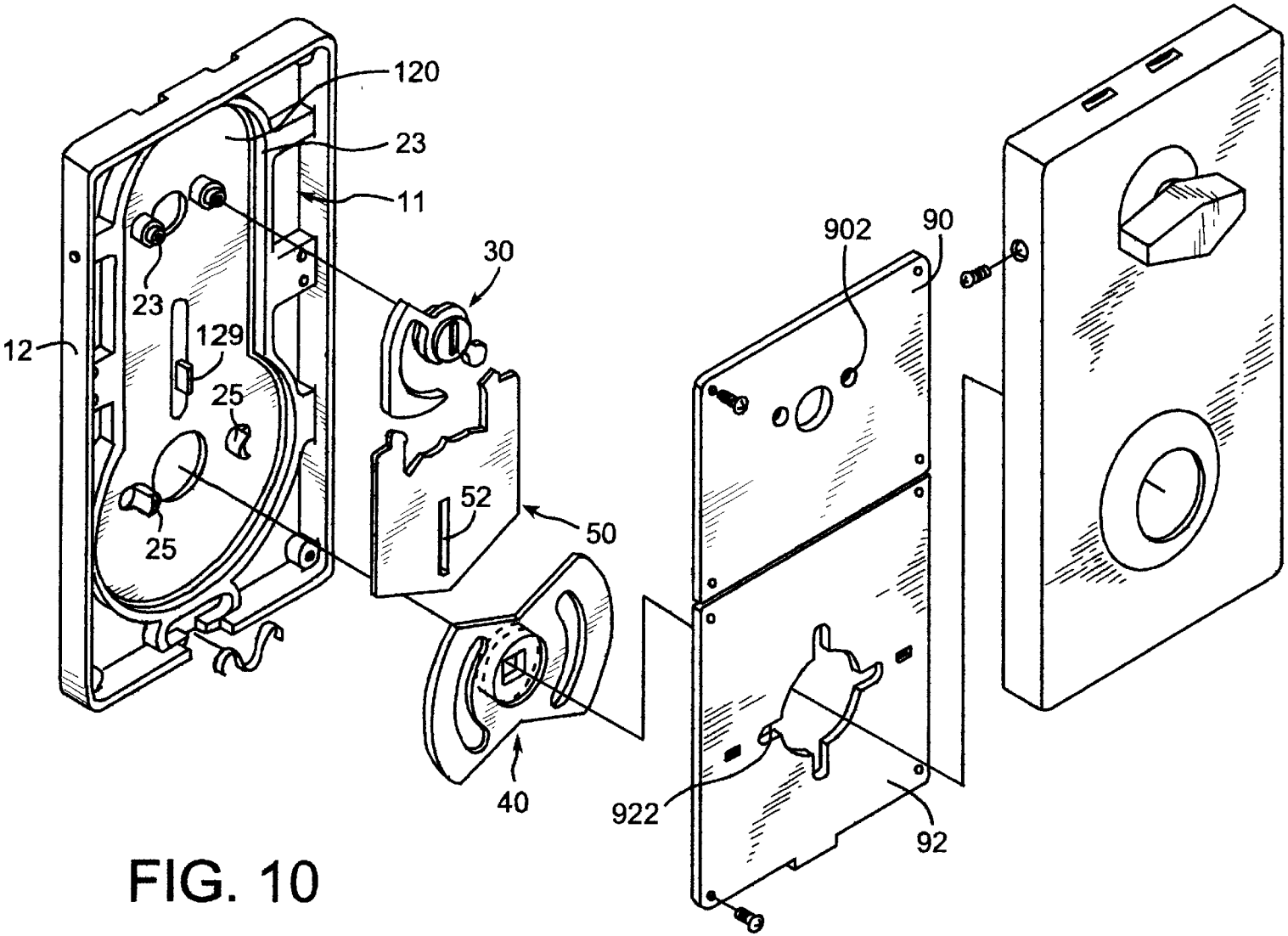
FIG. 10 is an exploded perspective view of a cartridge mechanism constructed in accordance with another embodiment of the present invention.

FIG. 10 shows a cartridge mechanism constructed in accordance with another embodiment of the present invention. In this embodiment, the structure of the swivel 30, the driver 40 and the slide 50 and their operation and interrelationship are essentially the same as the embodiment of FIGS. 1 through 9, except that only a single lengthwise slot 52 is formed on the slide 50. More significantly, as clearly shown, the bottom plate 12 is modified to have an integral spacer step 11 raised from a bottom face 120 thereof and only two flat housings, namely the upper housing 90 and the lower housing 92, are used to cooperate with the bottom plate 12.

Figure 11:
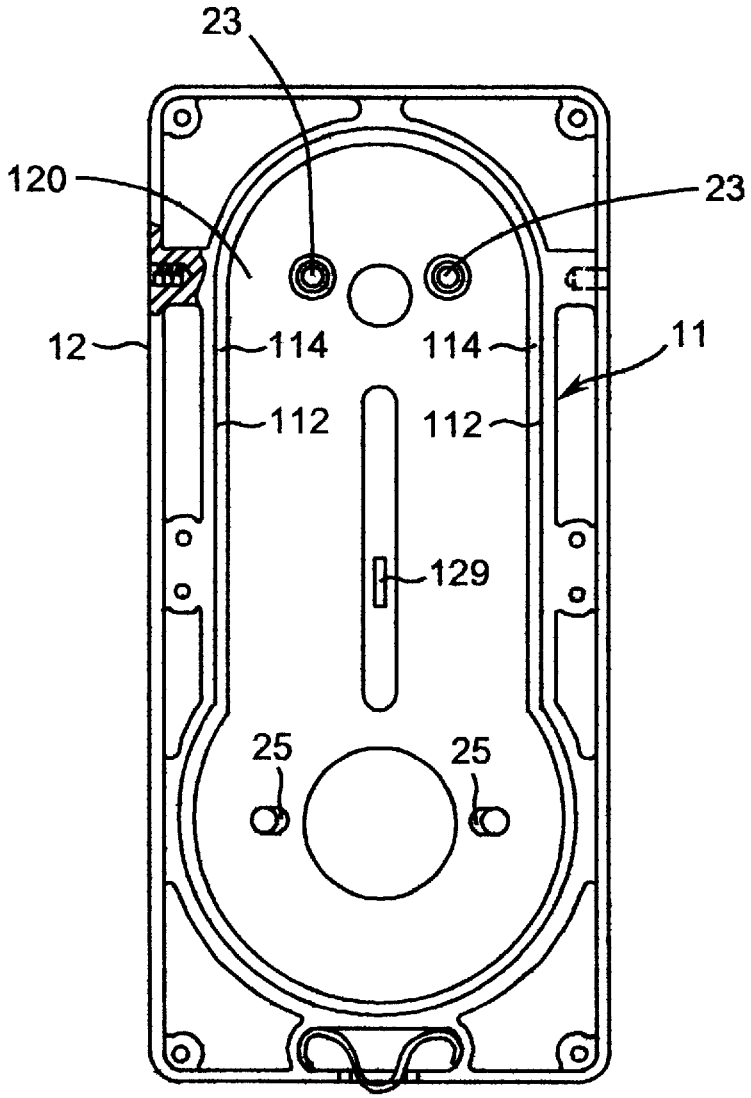
FIG. 11 is a plan view of a bottom plate shown in FIG. 10.

Referring to FIGS. 10 and 11, a pair of first spacer posts 23 and a pair of second spacer posts 25 are integrally formed on the bottom face 120 of the bottom plate 12, respectively. The portion of the first spacer posts 23 to be engaged with the upper housing 90 is similar to the spacer post 20. That is, the spacer post 23 is hollow for insertion of a fixing screw (not shown) and has a narrowed end portion and a neck so that the narrowed end portion can be inserted into the hole 902 and then stopped. The second spacer post 25 has a approximately crescent cross-section which, when the lower housing 92 is fixed, such as by screws, to the bottom plate 12, together with a recess 922 formed on the lower housing 92 defines a substantially circular hole (see FIG. 11). A fastener (not shown) then can pass through the circular hole and abut a top of the crescent spacer 25.

The spacer step 11 has a pair of substantially straight guiding walls 112 along the lengthwise direction of the bottom plate 12. A lateral distance between the two walls 112 is slightly larger than the width of the slide 50 so that the slide 50 can freely slide therein. The bottom plate 12 has a single guider 129 integrally formed to extend generally in the lengthwise direction of the bottom plate 12. The corresponding, single lengthwise slot 52 of the slide 50 is aligned with the guider 129. With the arrangement of the guiding walls 112 and the cooperation of the guider 129 and the slot 52, a smooth sliding movement of the slide 50 is provided. To insure a smooth operation of the slide 50, a portion of the bottom face 120 of the bottom plate 12 adjacent, to the pair of straight guiding walls 112 may be recessed such as a continuous recess 114, to remove any defects that might be occurred during molding the bottom plate 12. Also, a portion of the bottom face 120 of the bottom plate 12 surrounding the guider 129 may be suitably recessed for the same purpose.

Figure 13:
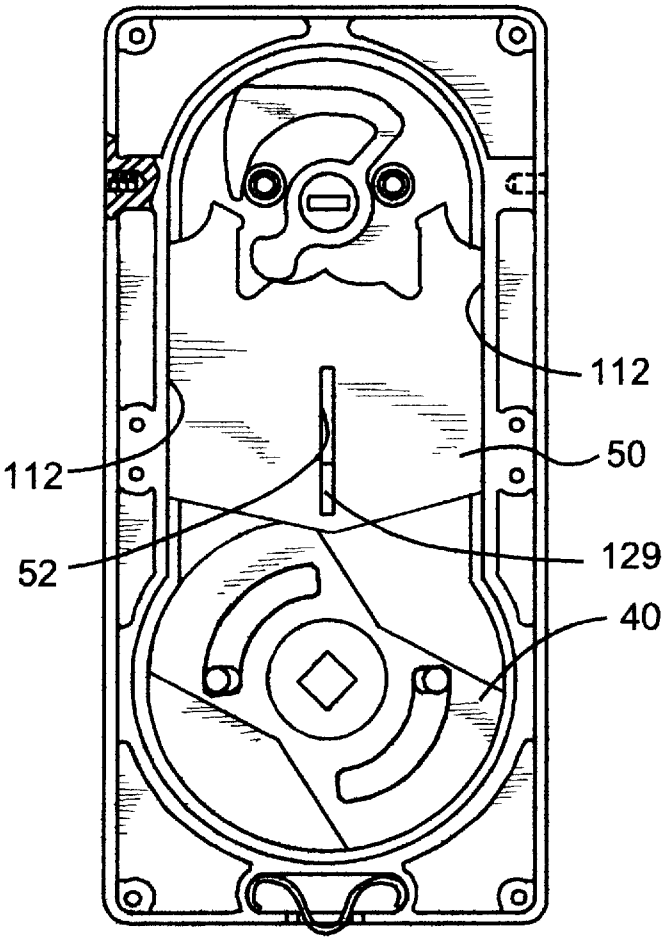
FIG. 13 is a view similar to FIG. 12 but showing a state where the driver is actuated to a maximum extent.
Figure 12:
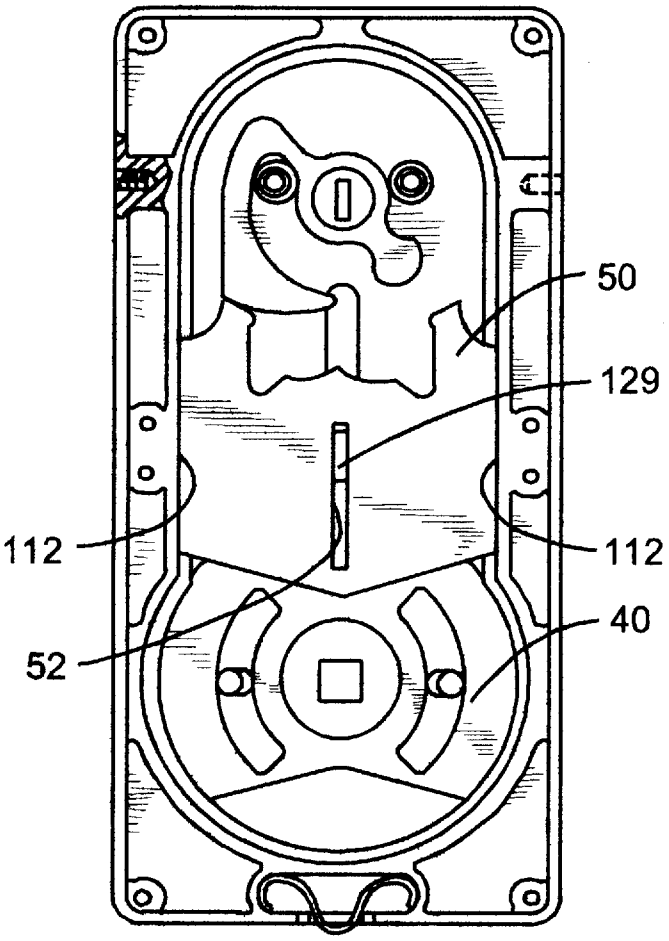
FIG. 12 is a schematic plan view showing an interconnection between a swivel, a slide and a driver of the cartridge mechanism of FIG. 10 where the driver is not yet actuated.

FIGS. 12 and 13 show the movement of the slide 50 under the guidance of the guider 129 and the straight guiding walls 112. The rest of the interconnection and operation between the swivel 30, the slide 40 and the driver 50 in this embodiment is essentially the same as the first embodiment so that a detailed description thereof is deemed not necessary.

It is to be understood that even though numerous characteristics and advantages of the present invention have been set forth in the foregoing description, the disclosure is illustrative only and changes may be made in detail, especially in matters of shape, size, and arrangement of parts within the principles of the invention to the full extent indicated by the broad general meaning of the terms in which the appended claims are expressed.

What is claimed is:

1. A cartridge for a lockset having a lock mechanism with a primary rotatable spindle and a secondary rotatable spindle, comprising:

a bottom plate having first and second openings through which the primary and the secondary rotatable spindles are passed, the bottom plate having a planar bottom face, a spacer step raised from the bottom face, and a guider extending generally in a lengthwise direction of the bottom plate;

upper and lower housings mounted over the spacer step of the bottom plate, each of the upper and lower housings having an opening through which a corresponding one of the primary and secondary rotatable spindles is passed;

a pair of first spacer posts each having one end seated on the bottom plate and another end seated on the upper housing, the pair of first spacer posts positively maintaining a predetermined distance between the upper housing and the bottom face of the bottom plate substantially constant;

a pair of second spacer posts each having one end seated on the bottom plate and another end seated on the lower housing, the pair of second spacer posts positively maintaining a predetermined distance between the lower housing and the bottom face of the bottom plate substantially constant;

a swivel rotatably disposed between the upper housing and the bottom plate, the swivel having a first cam arm and a second cam arm;

a slide having a lengthwise slot receiving the guider of the bottom plate, a pair of upper arms and a pair of intermediate recesses, each upper arm and each intermediate recess forming a respective cam surface thereon, the slide being guided by the spacer step and the guider to be slidable along the lengthwise direction of the bottom plate to turn the swivel, the cam surface on one of the upper arms engages the first cam arm to turn the swivel approximately 45°, immediately followed by the cam surface of one of the pair of intermediate recesses adjacent to the one upper arm engaging with the second cam arm such that when the first cam arm further rotates the swivel, the second cam arm completely engages with the intermediate recess to further turn the swivel approximately 45° when the first cam arm disengages with the cam surface of the upper arm; and a driver being adapted to turn the secondary rotatable spindle, the driver being operable to move the slide upward along the lengthwise direction of the bottom plate to turn the swivel.

2. The cartridge for a lockset as claimed in claim 1, wherein each spacer post of the second pair of spacer posts is crescent-shaped.

3. The cartridge for a lockset as claimed in claim 1, wherein a portion of the bottom face of the bottom plate surrounding the guider is recessed.

4. The cartridge for a lockset as claimed in claim 1, wherein the upper and lower housings are each substantially flat.

5. The cartridge for a lockset as claimed in claim 1, wherein the spacer step comprises a pair of substantially straight guiding walls and the slide comprises a pair of straight sides.

6. The cartridge for a lockset as claimed in claim 5, wherein a portion of the bottom face of the bottom plate adjacent to the pair of straight guiding walls is recessed.

7. The cartridge for a lockset as claimed in claim 1, wherein the slide has a lower side portion composed of two straight parts joined to form a central convexity and the driver has an upper side portion matching with the lower side portion of the slide and forming a central concavity.

8. The cartridge for a lockset as claimed in claim 1, wherein the spacer step, the guider, and the first and the second pair of spacer posts are integrally formed with the bottom plate.

9. The cartridge for a lockset as claimed in claim 1, wherein said guider extends from the planar bottom face of the bottom plate, and engages the lengthwise slot defined in the slide.

* * * * *